US005097265A

United States Patent [19]

Aw

[11] Patent Number: 5,097,265

[45] Date of Patent: Mar. 17, 1992

[54] TRIANGULAR TARGET BOAT REFLECTOR

[75] Inventor: Kenneth Aw, Camarillo, Calif.

[73] Assignee: The United States of America as represented by the Secretary of the Navy, Washington, D.C.

[21] Appl. No.: 724,085

[22] Filed: Jul. 1, 1991

[51] Int. Cl.[5] ..... H01Q 15/18

[52] U.S. Cl. ..... 342/7; 342/9

[58] Field of Search ..... 342/9, 7, 5

[56] References Cited

U.S. PATENT DOCUMENTS

| | | | |
|---|---|---|---|
| 3,010,103 | 11/1961 | Hopper et al. | 342/9 |
| 3,039,093 | 6/1962 | Rockwood | 342/7 |
| 3,153,235 | 10/1964 | Chatelain | 342/8 |
| 3,365,790 | 1/1968 | Brauer | 342/7 X |
| 3,568,191 | 3/1971 | Hiester et al. | 342/8 |
| 4,096,479 | 6/1978 | Van Buskirk | 342/7 |
| 4,148,033 | 4/1979 | Speckter | 342/7 |
| 4,241,349 | 12/1980 | Connell | 342/7 |
| 4,551,726 | 11/1985 | Berg | 342/7 |
| 4,733,236 | 3/1988 | Matosian | 342/7 |
| 4,996,536 | 2/1991 | Broadhurst | 342/7 X |

*Primary Examiner*—John B. Sotomayor

*Attorney, Agent, or Firm*—David S. Kalmbaugh

[57] ABSTRACT

An array of twenty corner reflectors with each corner reflector consisting of three mutually perpendicular reflecting planes whose intersection lie at a common point. The twenty corner reflectors are, in turn, configured to provide omni-directional reflection to incoming electromagnetic waves, while maintaining strong reflection characteristics.

6 Claims, 3 Drawing Sheets

TRIANGULAR TARGET BOAT REFLECTOR

BACKGROUND OF THE INVENTION

1. Field of the Invention

This invention relates generally to reflectors of electromagnetic waves, especially radar and, in particular, to a radar reflector used to calibrate shipboard and aircraft radar systems and to provide for a real time target for ship and aircraft weapons systems.

2. Description of the Prior Art

An isotropic microwave reflector is a reflector that reflects the wave back in the same direction as the incident wave regardless of the direction of the incident wave. This will occur by using corner reflectors which is the name commonly given to devices constructed with three mutually perpendicular reflecting planes whose intersection lie at a common point about an axis about which the planes are equally spaced. Incident electromagnetic energy entering the open face of the planes is reflected from two planes of the reflector in such a manner that it is returned parallel to the incident path independent of the angle of incidence of the electromagnetic energy on the reflector.

Radar reflectors and in particular corner reflectors are used with radar systems in a variety of ways such as to align the radar systems and provide measurements of the effectiveness of the radar system, and as a radar passive targets with a missile for tracking and targeting purposes. The corner reflectors constitute high reflectivity targets, that is high radar cross section targets that can be located in the radar examined field or attached to other targets to assist in location and identification of targets.

Maximum return is achieved when the incident electromagnetic wave generated by radar is targeted or aimed directly into a corner reflector. An ideal radar reflector would consist of a sphere having an infinite array of microscopic corner reflectors so as to provide for an omni-directional reflector with minimum destructive interference. However, such a design would be very costly, thus making it impractical. In the past, an omni-directional radar corner reflector has been developed wherein an array of trihedral corners, that is three planes each mutually perpendicular, are distributed on the surface of a sphere such as for example the radar reflector disclosed in U.S. Pat. No. 3,365,790. U.S. Pat. No. 4,551,726 discloses an omni-directional radar corner reflector constructed of a plurality of trihedral corner reflectors disposed in an edge to edge relationship such that when properly placed into a defined network provide the basis for constructing all members a deltatrihedral family of omni-directional radar reflectors.

Although the above described omni-directional radar reflectors have been found useful in their functional capacity, these corner reflectors do not provide for a high radar cross section which, in turn, results in a somewhat weakened radar reflection. In addition, there is for an omni-directional radar reflector which is cost effective to manufacture and is light weight so as to allow the reflector to be mounted on the mast of a target boat or the like.

It is therefore an object of the invention to provide an improved omni-directional radar reflector.

It is also an object of the invention to provide an improved omni-directional radar reflector which may be used as a target for different radar frequencies.

It is another object of the invention to provide an improved omni-directional radar reflector which reflects a greater portion of an incident electromagnetic waves than prior art devices.

It is still another object of the invention to provide an improved omni-directional radar reflector which is cost effective to manufacture and light in weight.

Other objects, advantages, novel features and applications of the invention will made apparent by the detailed description of the preferred embodiment of the invention.

SUMMARY OF THE INVENTION

The above and other objects of the present invention are accomplished by a corner reflector arrangement comprising an array of twenty corner reflectors with each corner reflector consisting of three mutually perpendicular reflecting planes whose intersection lie at a common point. The twenty corner reflectors are, in turn, configured to provide omni-directional reflection to incoming electromagnetic waves, while maintaining strong reflection characteristics.

DETAILED DESCRIPTION OF THE PREFERRED EMBODIMENT

Figure 1:
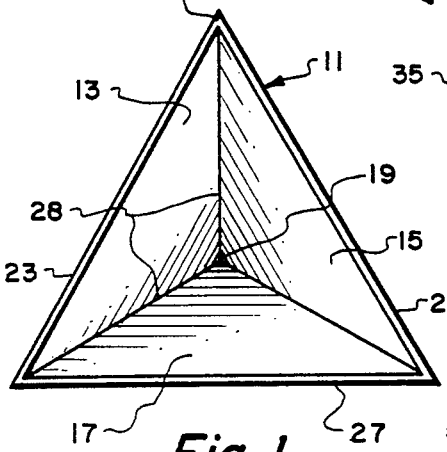
FIG. 1 illustrates a single trihedral corner reflector.

Referring first to FIG. 1 there is shown a trihedral corner reflector 11 made up of three mutually perpendicular isoselice triangular shaped reflecting surfaces 13, 15 and 17 whose intersection lie at a common vortex 19 about an axis about which the triangular shaped reflecting surfaces 13, 15 and 17 are equally spaced thereby forming a trihedral whose open frontal face is a projection of an equilateral triangle 21 having edges 23, 25 and 27. In the preferred embodiment of the present invention, the length of each side 28 of isoselice triangular shaped reflecting surfaces 13, 15 and 17 is determined in accordance with the following equations:

$$RCS = 10\log(4\cdot\pi\cdot A^2)/\lambda^2 \quad (1)$$

$$A = 4\cdot(l\cdot m/(l+m+n))\cdot b^2 \text{ where } l+m \leqq n \quad (2)$$

$$A = (l+m+n-(2/l+m+n))\cdot b^2 \text{ where } l+m \geqq n \quad (3)$$

where RCS is the radar cross section of corner reflector 11 in decibels per square meter, A is the projected area of equilateral triangle 21 in square meters, b is the length of each side 28 of corner reflector 11 and $1 \leqq m \leqq n$ are the cosines of the angles between the axes of the reflector 11 and a transmitter, not illustrated. For an RCS of 10 decibels per square meter, $\lambda$ equal to five gigahertz, l equal to cosine thirty degrees, m equal to cosine thirty degrees and n equal to cosine sixty degrees, solving expressions 1, 2 and 3 for b results in a length of 0.2 meters or 7.87 inches for each side 28 of corner reflector 11.

While the minimum length of 7.87 inches for each side 28 of corner reflector 11 provides a theoretical RCS of ten decibels per square meter, to compensate for attenuation loss, imperfection in materials and measurement instrumentation loss a length of ten inches was selected for each side 28 of corner reflector 11 was selected which, in turn, results in a length of approximately fourteen inches for edge of 23, 25 and 27 of equilateral triangle 21. It should be understood that a change in the frequency response of reflector 29 would result in change in the length of each side 28 of corner reflector 11.

Figure 2:
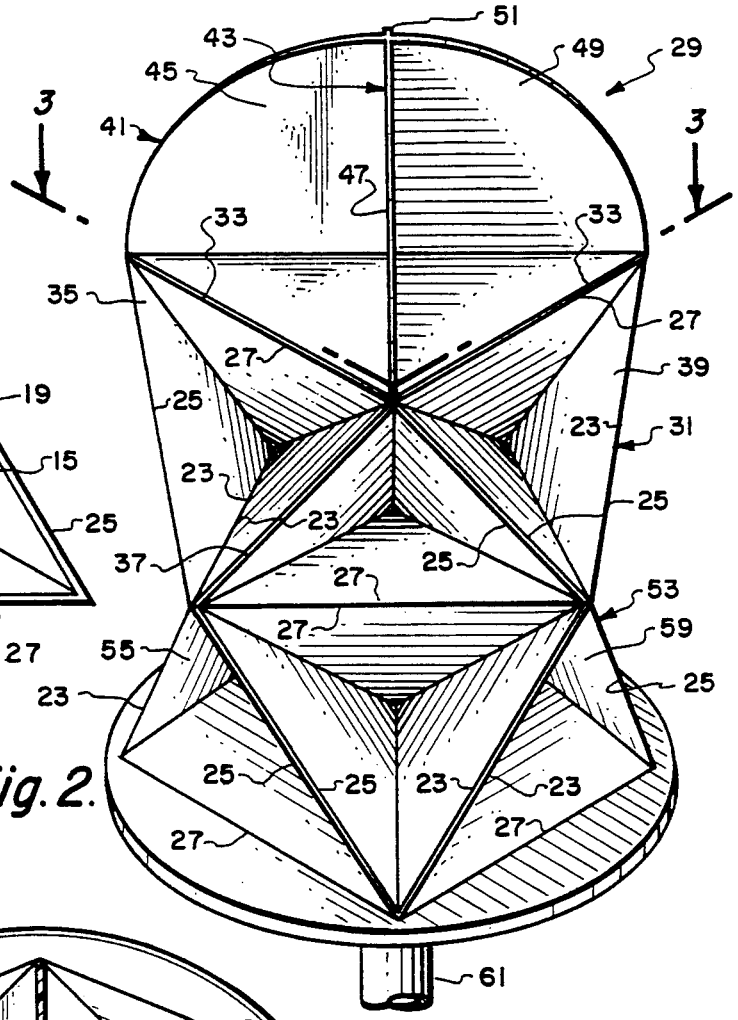
FIG. 2 illustrates a frontal isometric view of the triangular target boat reflector constituting the present invention.
Figure 3:
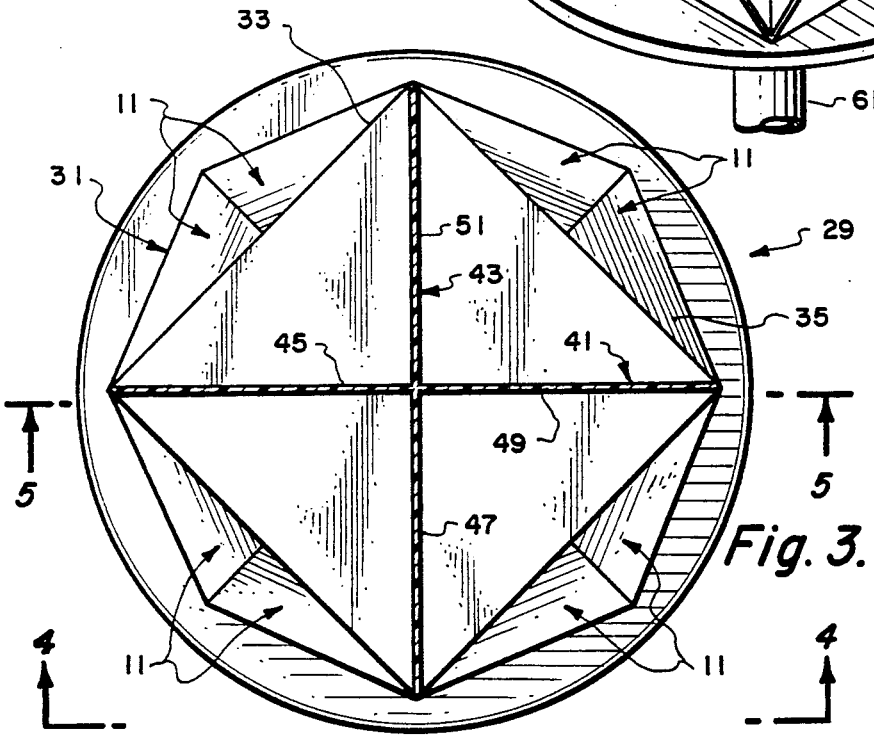
FIG. 3 is a cross sectional view taken on line 3—3 of FIG. 2 showing eight trihedral corner reflectors.
Figure 4:
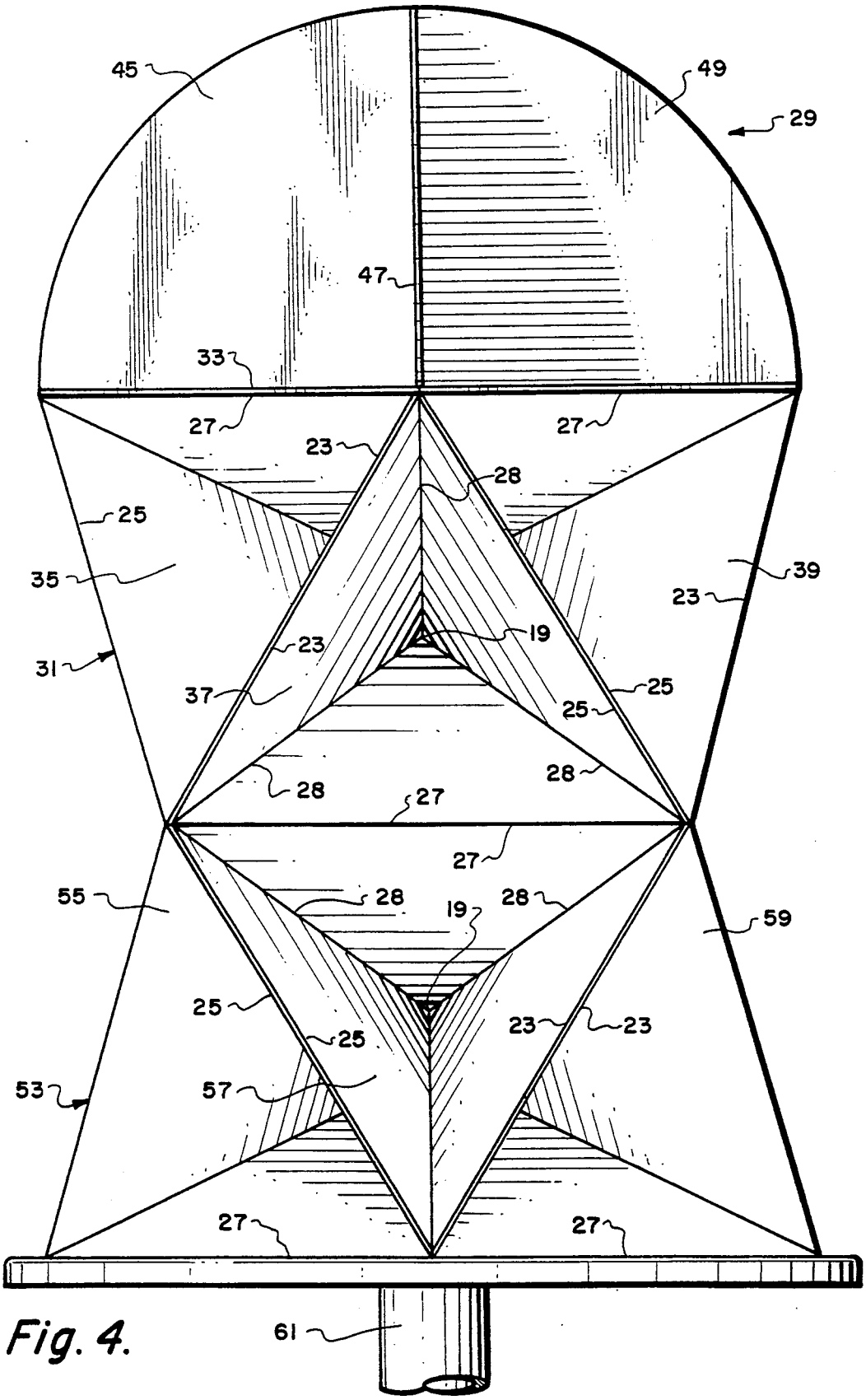
FIG. 4 illustrates a frontal view of the triangular target boat reflector constituting the present invention taken on line 4—4 of FIG. 3.

Referring to FIGS. 2, 3 and 4 there is shown a triangular target boat reflector 29 constituting the present invention which has eight trihedral corner reflectors 11, FIG. I, assembled in an edge to edge relationship forming a first polyhedron 31 having a continuous horizontal side of eight equilateral triangles 21, FIG. 1, and an upper surface 33 that is rectangular in shape. As is best illustrated by FIGS. 2, 3 and 4, in this arrangement edge 23 of a trihedral corner reflector 35 of polyhedron 31 is in an edge to edge relationship with edge 23 of a trihedral corner reflector 37 of polyhedron 31. In a like manner, edge 25 of a trihedral corner reflector 39 of polyhedron 31 is in an edge to edge relationship with edge 25 of trihedral corner reflector 37 of polyhedron 31.

There is mounted upon the upper surface 33 of polyhedron 31 and attached thereto an arrangement of two semicircular reflectors 41 and 43 which are orthogonal to each other and which when mounted upon upper surface 33 of polyhedron 31 form four corner reflectors 45, 47, 49 and 51 each having three mutually perpendicular reflecting surfaces which intersect at a common vortex. It should be noted that the radius of each corner reflector 45, 47,49 and 51 is ten inches. Corner reflectors 45, 47, 49 and 51, in turn, when configured in the manner illustrated in FIGS. 2, 3 and 4 optimize the radar cross section of reflector 29.

Referring again to FIGS. 2 and 4 reflector 29 has a second polyhedron 53 consisting of eight trihedral corner reflectors 11, FIG. 1, assembled in an edge to edge relationship such that polyhedron 53 has a continuous horizontal side of eight equilateral triangles 21 and is identical in shape to polyhedron 31. As is best illustrated by FIGS. 2 and 4, in this arrangement edge 25 of a trihedral corner reflector 55 of polyhedron 53 is in an edge to edge relationship with edge 25 of a trihedral corner reflector 57 of polyhedron 53. In a like manner, edge 23 of a trihedral corner reflector 59 of polyhedron 53 is in an edge to edge relationship with edge 25 of trihedral corner reflector 57 of polyhedron 53.

The lower surface of polyhedron 31 is mounted upon and attached to the upper surface of polyhedron 53 with edge 27 of trihedral corner reflector 57 aligned with edge 27 of trihedral corner reflector 37 as is best illustrated in FIGS. 2 and 4.

Figure 5:
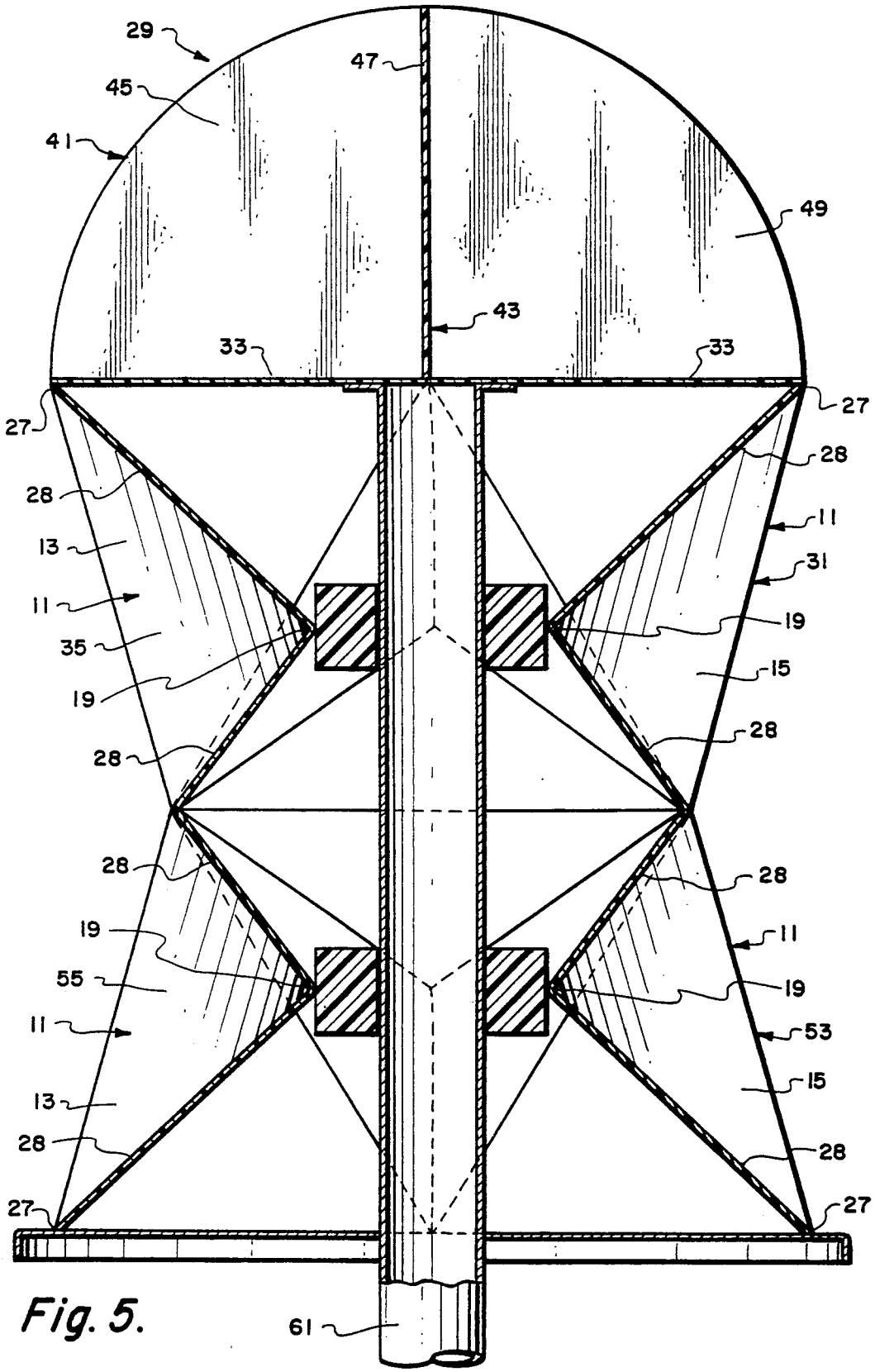
FIG. 5 is a cross sectional view taken on line 5—5 of FIG. 3 showing mounting means for the triangular target boat reflector.

Referring now to FIG. 5, triangular target boat reflector 29 is, in turn, supported by the mast 61 of a boat, not illustrated.

At this time, it should be noted that the corner reflectors of triangular target boat reflector 29 are fabricated from a light weight plastic and have a highly reflective metallic paint applied to each reflective surface thereof, although it should be understood that any well known light weight material with a highly reflective could be used to fabricate the corner reflectors of the present invention.

It should also be noted that the unique configuration of the twenty corner reflectors of triangular target boat reflector 29 provides for a radar cross section of approximately twelve decibels per meter irregardless of the angle of incidence of an incoming electromagnetic wave, that is reflector 29 is omni-directional. In addition, it should be noted that the configuration of the corner reflectors of reflector 29 prevents the loss of radar signature while a boat upon which reflector 29 is in a pitch, yaw or roll motion.

From the foregoing, it may readily be seen that the present invention comprises a new, unique and exceedingly useful triangular target boat reflector which constitutes a considerable improvement over the known prior art. Obviously, many modifications and variations may be made in light of the above teachings. It is therefore to be understood that within the scope of the appended claims that the invention may be practiced otherwise than as specifically described.

What is claimed is:

1. An electromagnetic wave reflector comprising:

a first polyhedron having eight trihedral corner reflectors, each of the trihedral corner reflectors of said first polyhedron having three mutually perpendicular isoselice triangular shaped reflecting surfaces intersecting at a common vortex about an axis about which said isoselice triangular shaped reflecting surfaces are equally spaced and an open frontal face projecting an equilateral triangle;

the equilateral triangles of the eight trihedral corner reflectors of said first polyhedron being positioned in an edge to edge relationship to form said first polyhedron such that said first polyhedron has a continuous horizontal side of eight equilateral triangles and a rectangular shaped upper surface;

a second polyhedron having eight trihedral corner reflectors, each of the trihedral corner reflectors of said second polyhedron having three mutually perpendicular isoselice triangles intersecting at a common vortex about an axis about which said isoselice triangles are equally spaced and an open frontal face projecting an equilateral triangle;

the equilateral triangles of the eight trihedral corner reflectors of said second polyhedron being positioned in an edge to edge relationship to form said second polyhedron such that said second polyhedron has a continuous horizontal side of eight equilateral triangles and rectangular shaped upper surface and lower surfaces, said first and second polyhedrons being identical in shape;

the lower surface of said second polyhedron being mounted upon the upper surface of said first polyhedron with the edges of the lower surface of second polyhedron being in alignment with the edges of the upper surface of said first polyhedron; and a pair of semicircular reflectors positioned orthogonal to each other and mounted upon the upper surface of said second polyhedron so as to form four corner reflectors, each of said four reflectors having three mutually perpendicular reflecting surfaces intersecting at a common vortex.

2. The electromagnetic wave reflector of claim 1 wherein each reflective surface of said corner reflectors is fabricated from plastic having a coating of reflective paint.

3. The electromagnetic wave reflector of claim 1 wherein the length of each leg of the three mutually perpendicular isoselice triangular shaped reflecting surfaces of each of said trihedral corner reflectors is approximately ten inches.

4. The electromagnetic wave reflector of claim I wherein the length of each edge of the equilateral triangles of said trihedral corner reflectors is approximately fourteen inches.

5. The electromagnetic wave reflector of claim 1 wherein said electromagnetic wave reflector provides a radar cross section of approximately twelve decibels per meter irregardless of the angle of incidence of an incoming electromagnetic wave.

6. The electromagnetic wave reflector of claim 1 wherein said electromagnetic wave reflector is mounted on the mast of a boat.

* * * * *